US006607294B2

(12) United States Patent
Taniuchi

(10) Patent No.: US 6,607,294 B2
(45) **Date of Patent: *Aug. 19, 2003**

(54) HEADLAMP

(75) Inventor: Hitoshi Taniuchi, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/972,845

(22) Filed: Oct. 5, 2001

(65) Prior Publication Data

US 2002/0071286 A1 Jun. 13, 2002

(30) Foreign Application Priority Data

| | | |
|---|---|---|
| Oct. 6, 2000 | (JP) | 2000-307933 |
| May 11, 2001 | (JP) | 2001-142072 |
| May 11, 2001 | (JP) | 2001-142080 |
| May 18, 2001 | (JP) | 2001-149414 |

(51) Int. Cl.[7] ..... F21V 7/00

(52) U.S. Cl. ..... 362/514; 362/513; 362/518; 362/297

(58) Field of Search ..... 362/513, 514, 362/518, 351, 538, 539, 297, 298, 302, 303

(56) References Cited

U.S. PATENT DOCUMENTS

| | | | | |
|---|---|---|---|---|
| 5,249,110 A | * | 9/1993 | Russello et al. | 362/294 |
| 5,967,647 A | * | 10/1999 | Eichler | 362/304 |
| 6,152,589 A | * | 11/2000 | Kawaguchi et al. | 362/518 |
| 6,419,380 B2 | * | 7/2002 | Oyama et al. | 362/517 |
| 2002/0089853 A1 | * | 7/2002 | Taniuchi et al. | 362/297 |

* cited by examiner

*Primary Examiner*—Thomas M. Sember
*Assistant Examiner*—John Amarantides
(74) *Attorney, Agent, or Firm*—Weingarten, Schurgin, Gagnebin & Lebovici LLP

(57) ABSTRACT

A headlamp in which a right elliptic reflecting surface and a left elliptic reflecting surface are provided on a position toward an upper front portion of the bulb, a right parabolic reflecting surface is provided on a position toward a right lower portion of said main reflecting surface, and a left parabolic reflecting surface is provided on a position toward a left lower portion of said main reflecting surface, whereby waste light can be recovered and used as irradiating light. A headlamp in which the elliptic reflecting surfaces which capture light emitted upwardly and forwardly from the bulb and parabolic reflecting surfaces which reflect said light in a desired direction are provided. A light-distribution varying means is provided in the optical path of the parabolic reflecting surfaces, whereby it becomes possible to switch between light distributions.

12 Claims, 13 Drawing Sheets

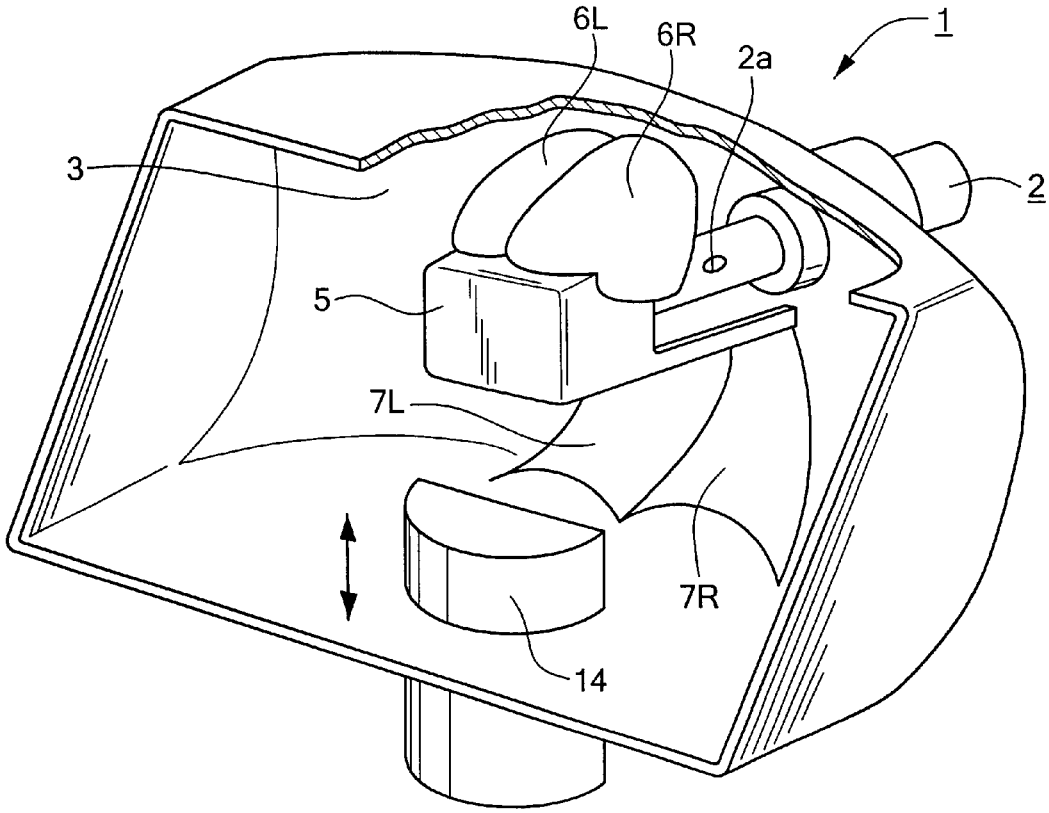
FIG. 11
FIG. 12
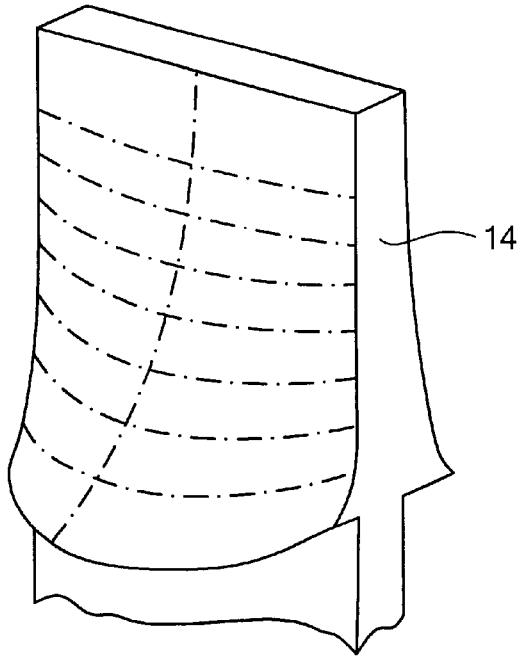

HEADLAMP

BACKGROUND OF THE INVENTION

1. Field of the Invention

This invention relates to a lamp for a vehicle and more particularly constitution of the lamp for the vehicle such as a headlamp and a fog lamp used for (the purpose of) illuminating, and the object of the invention is to provide the constitution capable of improving an utilization factor of luminous flux for a light source and allowing a light-distribution characteristic to be variable. Moreover, this invention relates to a headlamp which is installed on the vehicle and more particularly to constitution of the headlamp in which a light distribution for a low beam is made it possible to switch from and/or to a light distribution for an upper beam using a light source such as a metal halide discharge lamp which does not have both of a filament for a low beam and the filament for the upper beam, for example.

2. Detailed Description of the Prior Art

A prior constitution of a headlamp 90 of this type represented as an example in the case where a light source 91 is a metal halide discharge lamp or the like and the headlamp 90 is a exclusive-light distribution for a low beam is shown in FIG. 22, and FIG. 23, and a parabolic-reflecting surface 92 formed into a paraboloid of revolution or the like having a focus "f" in a rearward position is provided with respect to an arc 91*a* of said light source 91.

According to this constitution, since an downward light beam would be generated from a upper half portion of the parabolic-reflecting surface 92, and an upward light beam from a lower half portion, said light source 91 (the arc 91*a*) is provided with a shield plate 93 on the lower, thereby light to be shielded so as to not reach the lower half portion of the parabolic-reflecting surface 92. Moreover, said light source 91 also is provided with a stripe 91*b* by black opaque paint or the like and the stripe 91*b* serves a part of functions of said shield plate 93. In addition, said shield plate 93 is provided with a shade shielding a direct light.

According to this constitution, the light comes to reach only the upper half portion of said parabolic-reflecting surface 92, that is, most of the light becomes the downward light beam, and the light distribution for the low beam can be obtained as shown in FIG. 23. Moreover, the portion which the light of a part of the lower half portion of the parabolic-reflecting surface 92 reaches is a portion for forming a light distribution referred to as an elbow, which illuminates the side of the roadside zone with an appropriate upper light beam in order to facilitate to recognize visually a road sign or the like installed on a roadside zone in FIG. 23.

Moreover, the prior headlamp 90 having the constitution of the headlamp in which the light distribution for the low beam is made possible to switch from and/or to the light distribution for the upper beam using the light source which does not have both of a filament for a low beam and the filament for the upper beam is shown in FIG. 24 to FIG. 25, and the light source 91 are provided with the shade 92 for preventing for the direct light from this light source 91 from irradiating the portion other than the headlamp 90 and to become a glare light, as well as a movable shield plate 93 which can be set at two positions by a driving device 96 such as a solenoid, for example.

Moreover, the central portion of a reflecting mirror 94 provided in the rearward position of said light source 91 is formed into a main reflecting portion 94*a*, the upper thereof is formed into an auxiliary reflecting portion 94*b*, and the side surfaces of the right and left thereof is formed into an auxiliary reflecting portion 94*c* as shown in the drawings. Moreover, the lower is provided with a shield plate 95 since the light colored with yellow or the like would be irradiated when said light source 91 is the metal halide discharge lamp, and the reflecting mirror 94 can not be provided on the lower of the light source 91 with exception of a part required for forming the light distribution.

Moreover, said main reflecting portion 94*a* is formed into the paraboloid of revolution or the like having a focus in appropriate front of the light source 91, whereby the downward reflected-light is generated, and said auxiliary reflecting portion 94*b* and the auxiliary reflecting portion 94*c* are formed into the paraboloid of revolution or the like which has a focus at the light source 91, whereby the reflected light traveling in the horizontal direction is generated.

Moreover, said movable shield plate 93 shields the portion which would reach said auxiliary reflecting portion 94*b* and auxiliary reflecting portion 94*c*, of the light from the light source when the driving device 96 is not operated, whereas the movable shield plate 93 allows the light to launch into the entire surface of the reflecting mirror 94, that is, both of the main reflecting portion 94*a* and the auxiliary reflecting portion 94*b*, 94*c* when the driving device 96 is operated.

According to this constitution, the light distribution of the headlamp 90 is constituted by only the downward light from the main reflecting portion 94*a* as shown by a light distribution "S" in FIG. 26 when the driving device 96 is not operated, that is, becomes the light distribution for the low beam. A light distribution H1 to the horizontal direction from the auxiliary reflecting portion 94*b* and a light distribution H2 from the auxiliary reflecting portion 94*c* are added to the light distribution "S" when the driving device 96 is operated, and the light distribution for the upper beam can be obtained by synthesizing the light distribution "S", the light distribution H1 and the light distribution H2.

Moreover, at this point of time, said light distribution H1 is formed so as to illuminate the front of the vehicle like as a spot by the auxiliary reflecting portion 94*b* provided on the upper of the main reflecting portion 94*a* that a reflection image of the light source 91 is elongated in the vertical direction, on the other hand, the light distribution H2 is formed so as to illuminate the right and left of the traveling direction of the vehicle widely by the auxiliary reflecting portion 94*c* provided on the sides of the right and left of the main reflecting portion 94*a* that the reflection image of the light source 91 is elongated in the horizontal direction.

However, the utilization factor of luminous flux with respect to the light source 91 has been essentially low in the headlamp 90 according to the prior constitution described above, since only a substantial half of the parabolic-reflecting surface 92 is utilized in order to obtain the light distribution for the low beam. In addition thereto, there has been a problem in recent years that requirements or the like reducing a dimension of the up-and-down direction is increased for example, and it leads to reduction in square measure of said parabolic-reflecting surface 92, so that lack of illuminance of the headlamp 90 becomes noticeable increasingly due to the recognition that the headlamp 90 also supports a part of design of the vehicle. Moreover, there has been a problem in the headlamp 90 according to the prior constitution described above that the reflecting mirror 94 is compartmentalized into the main reflecting portion 94*a* and the auxiliary reflecting portion 94*b*, and the light distribution for the low beam used in most situation of the case of usual driving becomes dark since the auxiliary reflecting portion 94*b* is covered from the light source 91 in the case of the light distribution for the low beam.

SUMMARY OF THE INVENTION

This invention solves the problems by providing:

a headlamp constituted by providing on a substantial upper half portion a main reflecting surface formed into a parabolic surface providing a light-emitting source of a bulb as a substantial focus, wherein a right elliptic reflecting surface and a left elliptic reflecting surface providing the vicinity of a light-emitting source of a bulb as a primary focus respectively are provided on a position toward the front upper of the bulb in the form of being connected substantial along a center line of this headlamp, a second focus of said right elliptic reflecting surface being provided on the appropriate right side of said bulb, a second focus of said left elliptic reflecting surface being provided on the appropriate left side of said bulb, a right parabolic reflecting surface providing the second focus of said right elliptic reflecting surface as a focus is provided on a position toward the lower and right of said main reflecting surface, and a left parabolic reflecting surface providing the second focus of said left elliptic reflecting surface as a focus is provided on a position toward the lower and left of said main reflecting surface;

a headlamp constituted by providing on a substantial upper half portion a main reflecting surface formed into a parabolic surface providing a light-emitting source of a bulb as a substantial focus, wherein a right elliptic reflecting surface and a left elliptic reflecting surface providing the vicinity of a light-emitting source of a bulb as a primary focus respectively are provided on a position toward the front upper of the bulb in the form of being connected substantially along a center line of this headlamp, a second focus of said right elliptic reflecting surface being provided on the appropriate right side of said bulb, a second focus of said left elliptic reflecting surface being provided on the appropriate left side of said bulb, a right parabolic reflecting surface providing the second focus of said right elliptic reflecting surface as a focus is provided on a position toward the lower and right of said main reflecting surface, and a left parabolic reflecting surface providing the second focus of said left elliptic reflecting surface as a focus is provided on a position toward the lower and left of said main reflecting surface, and optical paths of the reflected light from said right parabolic reflecting surface and left parabolic reflecting surface are designed to be substantially parallel each other, or to intersect each other at front of the headlamp, as well as at least a part of the optical paths from said two parabolic reflecting surfaces is provided with a light-distribution varying means constituted by reflecting means or refracting means;

a headlamp constituted by providing on a substantial upper half portion a main reflecting surface formed into a parabolic surface providing a light-emitting source of a bulb as a substantial focus, wherein a right elliptic reflecting surface and a left elliptic reflecting surface providing the vicinity of a light-emitting source of a bulb as a primary focus respectively and each is formed into at least one piece are provided on a position toward the front upper of the bulb in the form of being connected substantially along a center line of this headlamp, a second focus of said right elliptic reflecting surface being provided on the appropriate right side of said bulb, a second focus of said left elliptic reflecting surface being provided on the appropriate left side of said bulb, at least a lower right reflecting surface which an ellipsoid providing the second focus of said right elliptic reflecting surface as a primary focus appears on a horizontal section on a position toward the lower and left of said main reflecting surface, and at least a lower left reflecting surface which the ellipsoid providing the second focus of said left elliptic reflecting surface as the primary focus appears on the horizontal section on the position toward the lower and right of said main reflecting surface; and a headlamp constituted by providing on a substantial upper half portion a main reflecting portion which is formed into a parabolic surface providing a light-emitting source as a substantial focus and forms a light distribution for the low beam, wherein the right and left of said main reflecting portion are provided with an auxiliary reflecting portion providing an irradiating direction as the front, and the front upper of said light source is provided with two elliptic reflecting surfaces providing said light source as a primary focus in a manner to stand face to face each other, and a second focus of these elliptic reflecting surfaces is provided at the vicinity of a side direction of said light source of the side in which the respective elliptic reflecting surface exists, and providing the second focus of said respective elliptic reflecting surface as a focus and a parabolic reflecting surface providing the irradiating direction as the front is provided on the lower of said main reflecting portion respectively, as well as the vicinity of said light source is provided with a movable shield plate, whereby light which is incident on said auxiliary reflecting portion from said light source and light which is incident on the parabolic reflecting surface from said elliptic reflecting surface can be designed to pass through and to be shielded; as specified means for solving the prior problems described above.

BRIEF DESCRIPTION OF THE DRAWINGS

FIG. 11 is a perspective view showing a fifth embodiment of a headlamp according to the invention.

FIG. 12 is a perspective view showing component parts of the fifth embodiment of a headlamp according to the invention.

DETAILED DESCRIPTION OF THE PREFERRED EMBODIMENT

Figure 1:
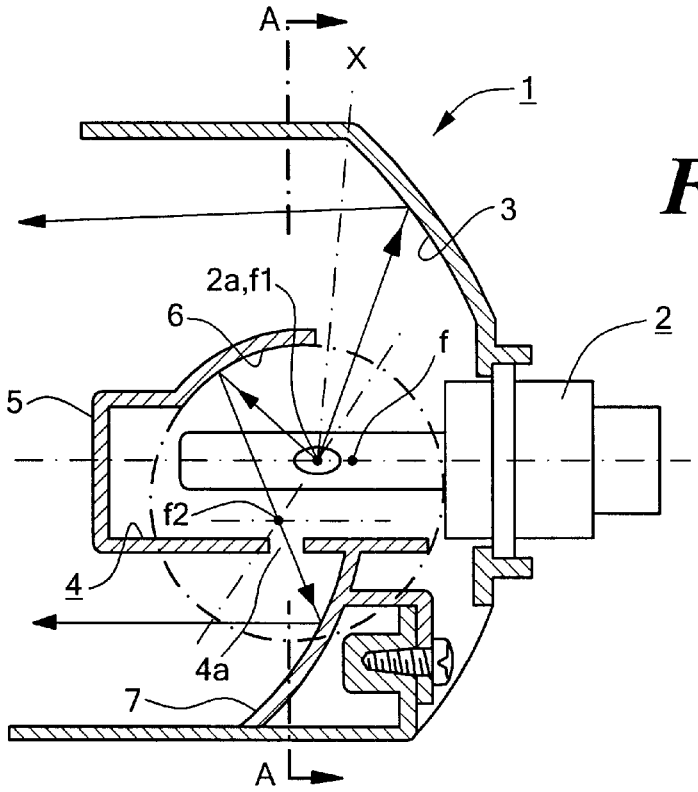
FIG. 1 is a front elevation showing a first embodiment of a headlamp according to the invention.
Figure 2:
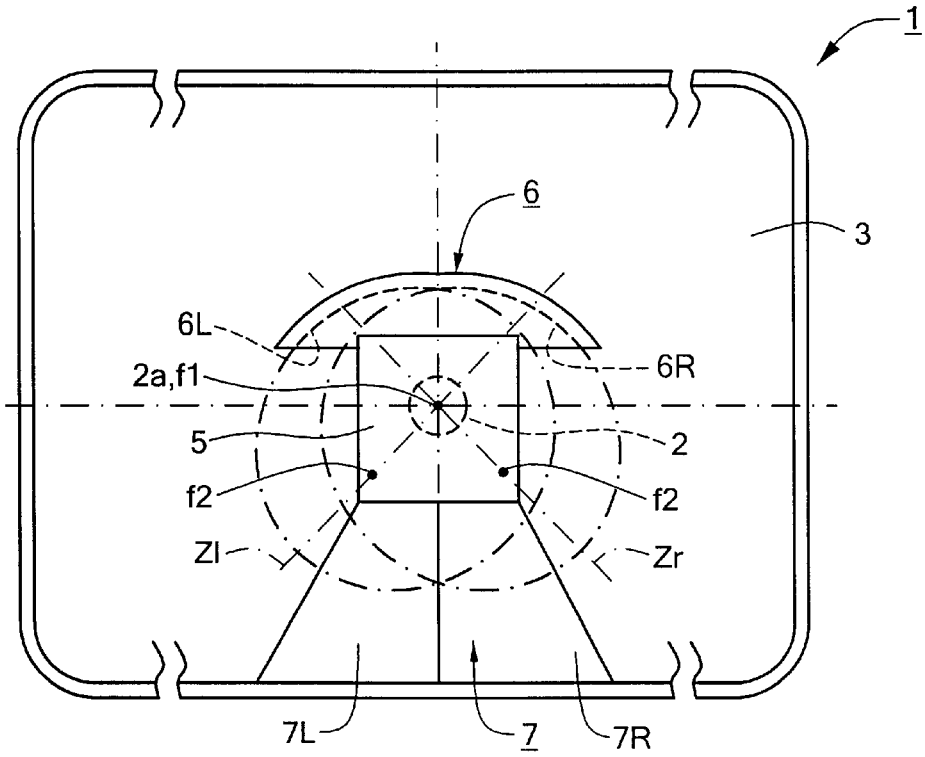
FIG. 2 is a sectional view along line A—A in FIG. 1

Next, the invention will be described in detail based on embodiments shown in drawings. FIG. 1 and FIG. 2 shows a basic constitution with exception of a part of a light-distribution varying means 10 for a headlamp 1 according to the invention, and although said headlamp 1 will be described, assuming that a bulb 2 of a discharge lamp such as a metal halide discharge lamp is provided as a light source, for example, in this first embodiment, it is needless to say that the same constitution also can be applied to an incandescent lamp such as a halogen lamp.

Moreover, although it is the same as a prior example in the point that the headlamp 1 also is provided with a main reflecting surface 3 formed into the parabolic reflecting surface or the like which a focus "f" is set at the rear of a arc 2*a* of the light source of said bulb 2, the main reflecting surface 3 is formed with only the upper half portion including the lower half portion of a part forming an elbow described in the prior example in this invention.

Moreover, although it is the same as prior examples in the point that a shield plate 4 for forming a light distribution for the low beam is provided together with stripes (not shown) provided on the bulb 2, covering the lower of said bulb 2, this shield plate 4 is provided with an opening 4*a* with an appropriate external diameter which will be described in detail below on an appropriate position.

In addition, although a shade 5 for preventing for direct light being radiated to an exterior to cause a glare to a driver of an on-coming vehicle is provided on the front of the light source 2, a pair of elliptic reflecting surfaces 6 formed into an ellipsoid of revolution providing said arc 2*a* as the primary focus f1, that is, a right elliptic reflecting surface 6R and a left elliptic reflecting surface 6L are provided on a part of said shade 5 according to the invention. Moreover, the right and left is referred with respect to the condition at viewing the headlamp 1 from the front in this description.

At this point, describing a constitution of said elliptic reflecting surfaces 6R and 6L, first, a primary focus f1 of the right elliptic reflecting surface 6R of one hand of a pair elliptic reflecting surfaces is positioned at the arc 2*a*, and the secondary focus f2 thereof is positioned at the appropriate right side of said bulb as shown in FIG. 2. Therefore, a major axis Zr of this right elliptic reflecting surface 6R rises toward the left in the condition viewing the headlamp 1 from the front.

Moreover, the left elliptic reflecting surface 6L of the other of a pair is formed in a manner to position the primary focus f1 at the arc 2*a*, as well as to position the primary focus f2 at the left of said bulb 2 appropriately, and the major axis Z1 thereof rises toward the left. At this point, since both the elliptic reflecting surfaces 6 (R, L) are formed into the same shape basically, these are coupled each other along the center line of the headlamp 1 vertically.

Moreover, the end of the position toward said main reflecting surface of both the elliptic reflecting surfaces 6 (R, L) is formed so as to come to the vicinity of a line X connecting a substantial center of said arc 2*a* and the outside end of the main reflecting surface 3 as shown in FIG. 1, whereby luminous flux which is radiated toward the outside end of the main reflecting surface 3 from said arc 2*a* is designed to be not shielded.

Moreover, a right parabolic reflecting surface 7R which this secondary focus f2 is provided as a focus and is formed into paraboloid of revolution or the like, and which has the substantially same optical axis as the irradiating direction of the headlamp 1 is provided, corresponding to the secondary focus f2 of the right elliptic reflecting surface 6R, and a left parabolic reflecting surface 7L which has the same constitution as the right parabolic reflecting surface 7R and which this secondary focus f2 is provided as a focus f2 is provided, corresponding to the secondary focus f2 of the left elliptic reflecting surface 6L.

In this case, in this invention, since only the substantial upper half portion of said main reflecting surface 3 is provided as also described above, it is provided corresponding to the position of the lower half portion omitted, whereby an optical interference with said main reflecting surface 3 is designed to not cause.

Here, discussing an optical path from the elliptic reflecting surfaces 6 (R, L) to the parabolic reflecting surfaces 7 (R, L) in detail, a shield plate 4 exists therebetween. Accordingly, what is provided is said opening 4*a*, and it is provided in order to secure the optical path for light reflecting from said elliptic reflecting surfaces 6 (R, L) to reach the parabolic reflecting surfaces 7 (R, L).

Moreover, there has been the possibility that function as the shield plate 4 is detracted, since said opening 4*a* is provided and direct light from the arc 2*a* also leaks from this opening 4*a*. Accordingly, it is assumed that the secondary focus f2 exists in the vicinity of said shield plate 4 when setting the shape of the elliptic reflecting surfaces 6 (R, L).

Or reversely, assuming that said shield plate 4 exists in the vicinity of the secondary focus f2 when setting the shape of the shield plate 4, the secondary focus f2 is positioned at the position on which reflected light from the elliptic reflecting surfaces 6 (R, L) converges, whereby a bore of the opening 4*a* can be made small and influence of leakage light can be minimized.

According to the described-above constitution, the head lamp 1 according to this invention is provided in a manner that said elliptical reflective surfaces 6 (R, L) covers the bulb 2 from the upper front, whereby the elliptic reflecting surfaces 6 (R, L) can capture light which can not be captured by the main reflecting surface 3 and has the direction having the possibility which becomes direct light, that is, luminous flux from the bulb 2 which heretofore has been invalid to launch it on the parabolic reflecting surfaces 7 (R, L) and to allow it to use as irradiation light of head lamp 1.

Moreover, since said elliptical reflective surfaces 6 (R, L) is established so as to capture light of the range which the main reflective surface 3 can not capture, when the captured amount of luminous flux is decreased by miniaturizing the main reflective surface 3, for example, it also becomes possible to supply it by the elliptical reflective surfaces 6 (R, L), whereby light of a level required for the headlamp 1 can be secured. Moreover, a reference numeral 10 in drawings shows a light-distribution varying means which will be described in detail hereinafter.

Figure 3:
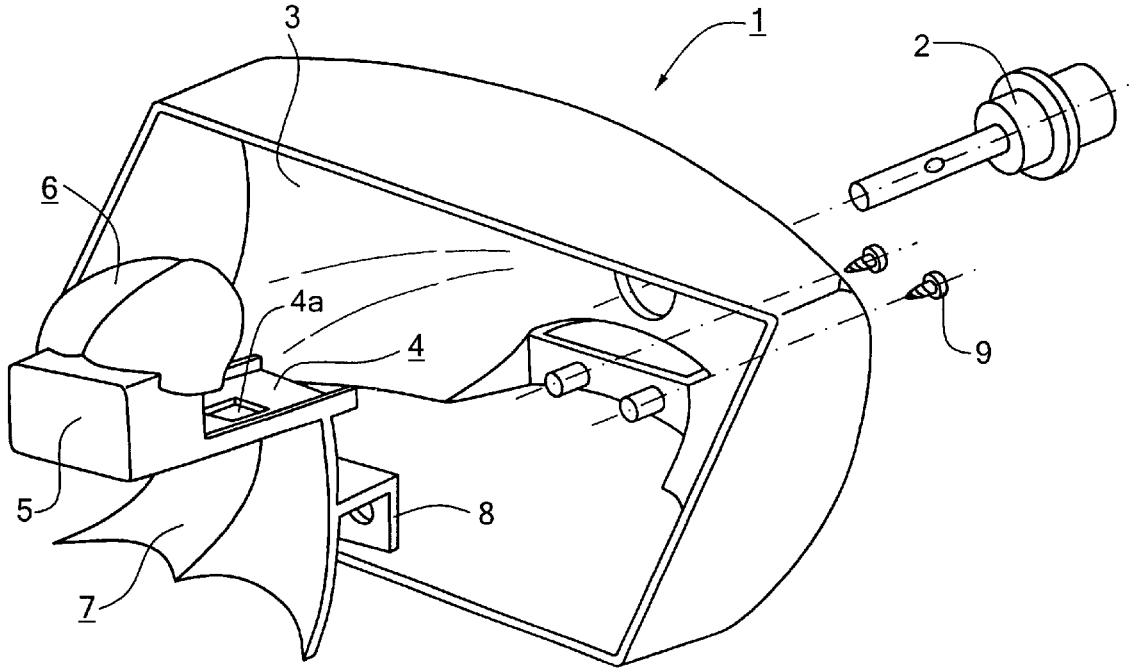
FIG. 3 is a perspective view showing a second embodiment of the headlamp according to the invention, the view being shown by component parts.

FIG. 3 shows further embodiment of the headlamp 1 according to this invention, and this embodiment is a specified constitution according to the elliptic reflecting surfaces 6 (R, L) and the parabolic reflecting surfaces 7 (R, L). A considerably high accuracy is required for each of a combination of the right elliptic reflecting surface 6R and the right parabolic reflecting surface 7R and a combination of the left elliptic reflecting surface 6L and the left parabolic reflecting surface 7L in a mutual relationship when providing the described-above constitution, when constituted as described above. Moreover, an installation accuracy consistent therewith also is required for the bulb 2.

Accordingly, according to the invention, said elliptic reflecting surfaces 6 (R, L) and parabolic reflecting surfaces 7 (R, L) are formed by integrally molding with a mold, including the shield plate 4 and the shade 5, and in this case, basically, an installation section 8 on said main reflective surface 3 is provided in advance such as an installation position with the bulb 2 to be installed on the main reflecting surface 3 comes to the predetermined position.

Since only the upper half portion of the main reflecting surface 3 is used, when this headlamp 1 is to form the light distribution for the low beam as is described above, said installation section 8 may be formed on the lower half portion of the main reflecting surface 3 by engaging with a screw 9 or the like.

At this point, the light directed downwardly can not be used substantially for the headlamp 1 in which is required to be monochromic in color of light, since the light slightly colored yellowly is emitted downwardly due to precipitation of a metal halide substance when the light source is the bulb 2 of the metal halide discharge lamp in particular, and therefore, it is reasonable means for recovering the light which is emitted upwardly except for the light which reaches the main reflecting surface 3 through two elliptic reflecting surfaces 6 (R, L) according to the invention.

Moreover, since the lower half portion of the main reflective surface 3 is the portion which can not be used substantially because of the same reason as described above when in addition, the light source is the bulb 2 of the metal halide discharge lamp, it can not be caused completely an inconvenience due to installing moldings obtained by integrally molding said elliptic reflecting surfaces 6 (R, L), parabolic reflecting surfaces 7 (R, L), shield plate 4 and shade 5 on the lower half portion of the main reflective surface 3.

Figure 4:
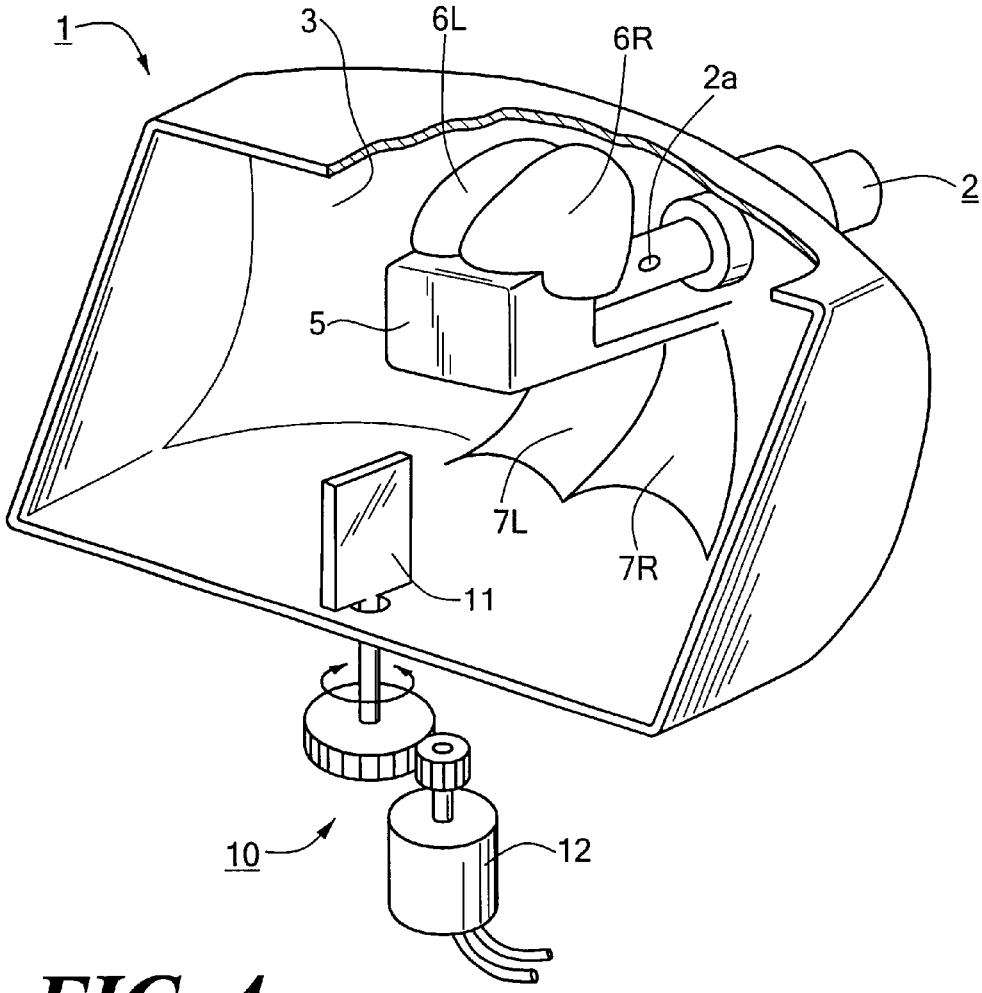
FIG. 4 is a perspective view showing a third embodiment of a headlamp according to the invention.
Figure 5:
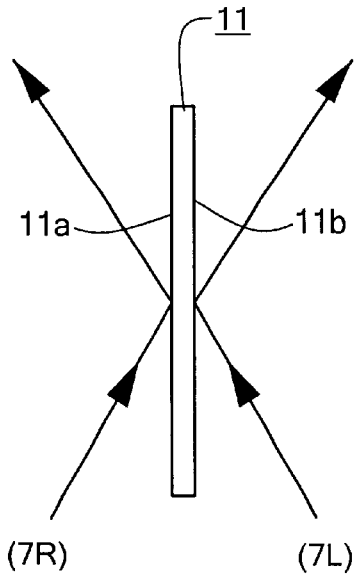
FIG. 5 is an illustration showing a condition, at the time when being not operated, of a third embodiment of a headlamp according to the invention, the illustration being shown by component parts.

FIG. 4 shows a third embodiment where building a light-distribution varying means 10 in a basic constitution described above to constitute said headlamp 1 as a variable light-distribution type and, in this first embodiment, the light-distribution varying means 10 is constituted by a rotary mirror 11 turned by a motor 12 or the like interlocking with a steering operation, for example, and is exists in the optical path from the parabolic reflecting surfaces 7 (R, L) always.

Moreover, it is effective that luminous flux from the parabolic reflecting surfaces 7 (R, L) is designed to intersect each other at the vicinity of the rotary mirror 11 in advance so as to launch light into the rotary mirror 11 sufficiently, since the light from said parabolic reflecting surfaces 7 (R, L) is incident on the rotary mirror 11 sufficiently to set an angle of the rotary mirror 11 at reflecting or the like, whereby characteristic is changed in this case.

Moreover, although the third embodiment will be described, assuming that both of a frontal surface 11*a* and a rear surface 11*b* of said rotary mirror 11 are finished into mirror surfaces, appropriate projections and depressions may be provided freely for the purpose of diffusing the light after reflecting in the horizontal direction, or the mirror may be formed into a curved surface freely along the traveling direction of the light of the parabolic reflecting surfaces 7 (R, L), for example.

Moreover, the main reflecting surface and the right elliptic reflecting surface are in proper alignment that the amount of recovery can be increased by enlarging the left and right elliptic reflecting surfaces in dimension when the main reflecting surface is miniaturized, and the headlamp can be constituted without lots of loss in an entire amount of light of the headlamp even in the case that miniaturization in the main reflecting surface is required in particular, whereby flexibility in design also can be increased and extremely excellent effects can be performed for improvement in fine view.

Figure 6:
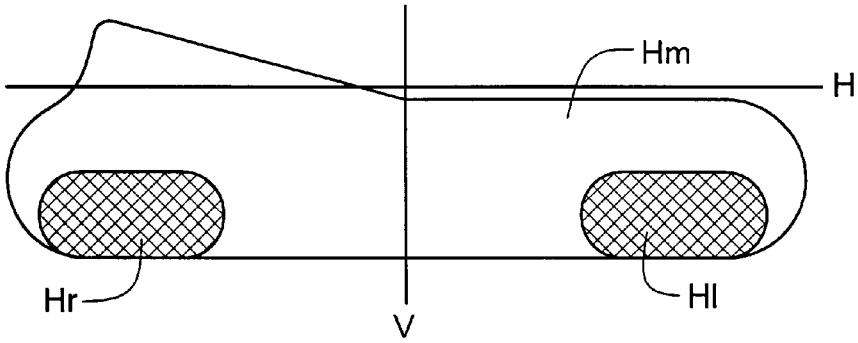
FIG. 6 is an illustration showing a condition of a light distribution at the time when being not operated.

Moreover, FIG. 5 to FIG. 8 show actions and effects of the third embodiment constituted as described above. First, the front surface 11*a* and the back surface 11*b* of said rotary mirror 11 are in parallel to the traveling direction of the vehicle when the steering is not operated as shown in FIG. 6. Therefore, the light from the parabolic reflecting surfaces 7 (R, L) is reflected by the front surface 11*a* and the rear surface 11*b* and to be radiated to the exterior in the condition that the directions are reversed, whereby a light distribution Hr and a light distribution Hl, as well as a light distribution Hm are formed by the light from the main reflecting surface 3, thereby the light distribution for the low beam to be formed, for example as shown in FIG. 6.

Figure 7:
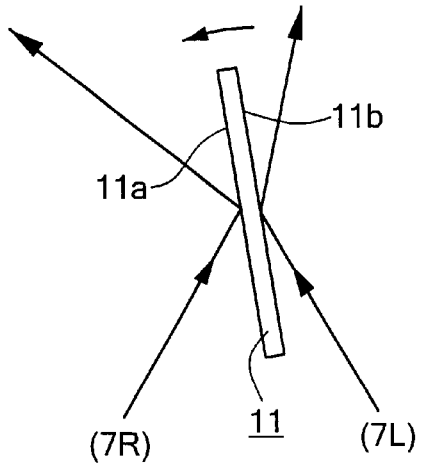
FIG. 7 is an illustration showing a condition, at the time when being operated, of a third embodiment of a headlamp according to the invention, the illustration being shown by component parts.
Figure 8:
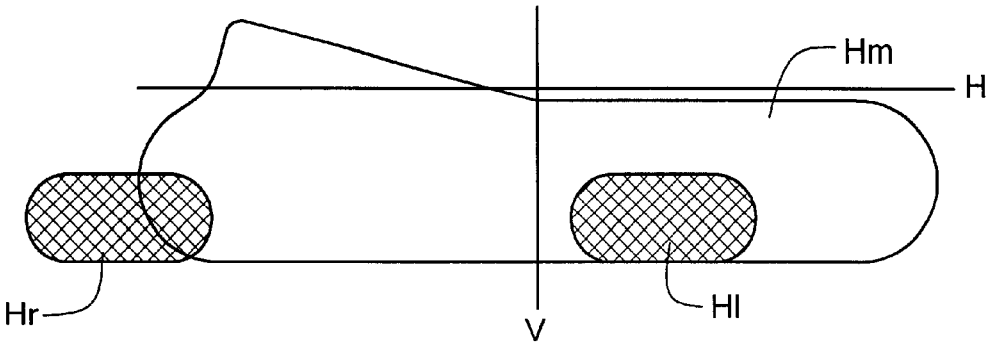
FIG. 8 is an illustration showing a condition of a light distribution at the time when being operated.

Moreover, the rotary mirror 11 also is turned toward a turning direction of the vehicle as shown in FIG. 7 when operating the steering in order to turn to the left, for example, and therefore, the light distribution Hr from the parabolic reflecting surface 7R and the light distribution Hl from the parabolic reflecting surface are shifted toward the left with respect to the light distribution Hm from the main reflecting surface 3 as shown in FIG. 8.

Figure 9:
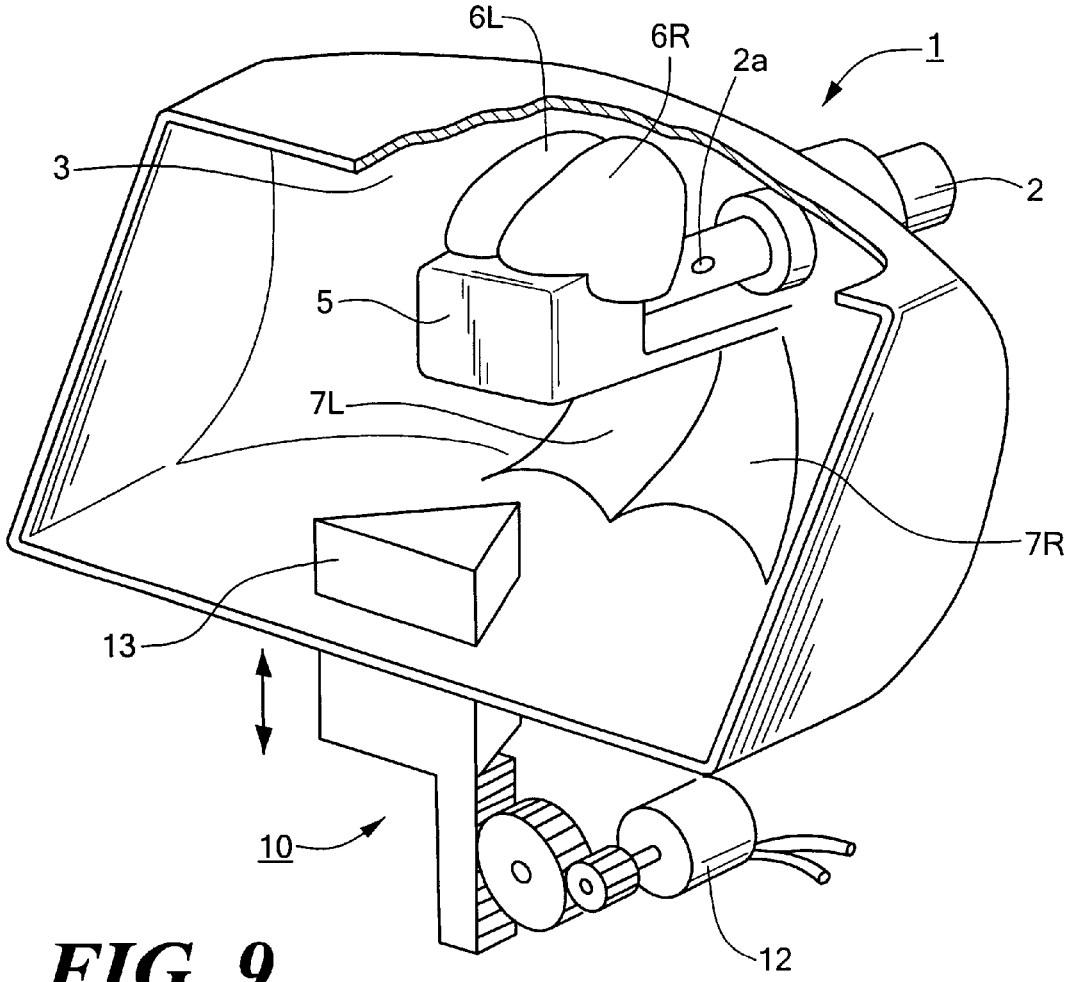
FIG. 9 is a perspective view showing a fourth embodiment of a headlamp according to the invention.

FIG. 9 shows a fourth embodiment according to the invention. The rotary mirror 11 of reflecting means exists in the optical path from the parabolic reflecting surfaces 7 (R, L) always, and the direction of light is changed by rotating the mirror as required in the previous fourth embodiment. In contrast with this, said reflecting means is a movable mirror 13 which enters into or exits from the optical path from said parabolic reflecting surfaces 7 (R, L) as required in this fourth embodiment. Moreover, this fourth embodiment will be described, assuming that the light from said parabolic reflecting surfaces 7 (R, L) is parallel light traveling toward a frontal direction of the headlamp 1.

Moreover, said movable mirror 13 is formed into a substantial wedged shape forming the bulb 2 (light source) sides into a top in this fourth embodiment. However, it also may be the constitution that the wedge-shape bodies different in an angle of said top described above are stacked, or the constitution that the top becomes large successively as advancing downwardly as required, from a viewpoint of forming a light distribution characteristic.

The movable mirror 13 formed as described above enters into or exits from the optical path from said parabolic reflecting surfaces 7 (R, L) so as to be inserted at low-speed driving and to leave at high-speed driving corresponding to a speed of a vehicle, for example.

Figure 10:
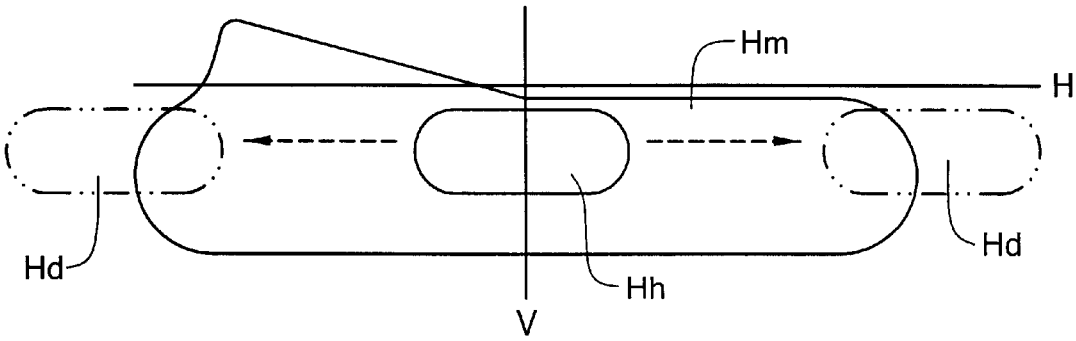
FIG. 10 is an illustration showing a condition of a light distribution obtained by the fourth embodiment.

According to this constitution described above, the light from the parabolic reflecting surfaces 7 (R, L) can be located within the light distribution Hm from said main reflecting surface 3, and forms the light distribution Hh for high-speed driving irradiating as a spot a frontal road surface of the traveling direction of the vehicle at high-speed driving, and is split into the left and right by the movable mirror 13 and to form two light distributions Hd for low-speed driving irradiating the left and right direction of the vehicle widely at low-speed driving in a city area or the like as shown in FIG. 10.

FIG. 11 shows a fifth embodiment according to the invention. Although both the light-distribution varying means 10 of the third and fourth embodiments have been constituted by the reflecting means such as the rotary mirror 11 and the movable mirror 13, the present invention should be limited thereto and refracting means such as lens also may be used.

On the one hand, said light-distribution varying means 10 is replaced with a movable lens 14 which enters into or exits from the optical path from the parabolic reflecting surfaces 7 (R, L) by the same mechanism as the fourth embodiment described above by operating of a driver, and is formed into a cylindrically-shaped lens having an axis of the up-and-down direction, for example in this fifth embodiment.

Moreover, this fifth embodiment will be described, assuming that the light from said parabolic reflecting surfaces 7 (R, L) is parallel light traveling toward a frontal direction of the headlamp 1.

At this point, in this fifth embodiment, said movable lens 14 is formed into a shape which a substantial arc of which curvature becomes large increasingly appears on a cross section of the horizontal direction, and is formed into a shape which a prism shape increasing the degree that light is refracted downwardly appears on a cross section of the vertical direction as shown in FIG. 12. And then, said movable lens 14 is inserted into luminous flux from said parabolic reflecting surfaces 7 (R, L) at city-area driving. Moreover, said movable lens 14 is designed to exit from luminous flux from the parabolic reflecting surfaces 7 (R, L) by operating a switch or the like, when the necessity is recognized by the driver at suburb driving, or at driving on an express way and so forth.

Figure 13:
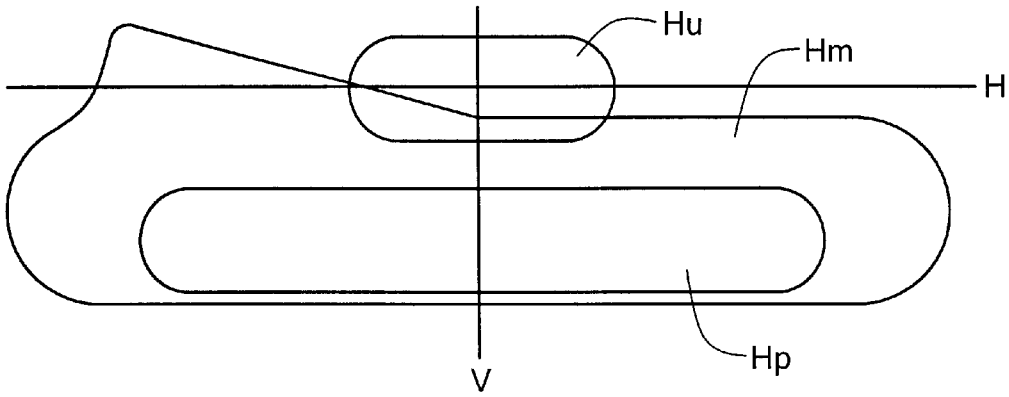
FIG. 13 is an illustration showing a condition of a light distribution obtained by the fifth embodiment.

FIG. 13 is an illustration showing a condition of a light distribution in the fifth embodiment constituted as described above. First, when the movable lens 14 is inserted at city-area driving, the light from said parabolic reflecting surfaces 7(R, L) is diffused to the left and right, as well as is refracted downwardly, and a light distribution Hp irradiating the front of the vehicle widely with the downward light can be obtained.

At this point of time, since the light from the main reflecting surface 3 forms the light distribution for the low beam Hm, the function as the light distribution for the low beam can not be lost even when the light Hp from the parabolic reflecting surfaces 7 (R, L) which is downward and wide in the horizontal direction is added thereto, whereby the intensity in light is increased more and more by the addition of the light described above, and improvement in visibility or the like can be obtained.

At this point, said movable lens 14 initiates to exit from luminous flux from the parabolic reflecting surfaces 7 (R, L) when the driver performs the steering operation in order to enter the express way, for example, and the light from the parabolic reflecting surfaces 7 (R, L) and in response thereto, irradiation toward the horizontal direction is limited in width increasingly, as well as the irradiating direction is changed from downward to the horizontal direction, and the light distribution Hu irradiating the front of the vehicle as the spot is formed at the time when the exit is completed, whereby it becomes possible to switch between the light distribution for the low beam and the light distribution for the upper beam.

Moreover, a lower right reflecting surface 7R is provided, corresponding to the secondary focus f2 of the right elliptic reflecting surface 6R, and a lower left reflecting surface 7L is provided corresponding to the secondary focus f2 of the left elliptic reflecting surface 6L. At this point of time, said lower right reflecting surface 7R and lower left reflecting surface 7L are designed such that the ellipsoid providing the second focus of said elliptic reflecting surfaces 6 as a primary focus appears on at least the cross section of the horizontal direction (in the condition mounted on the vehicle, and similarly to the vertical direction) in this invention.

Said lower reflecting surfaces 7 (R, L) further will be described in detail. These lower reflecting surfaces 7 (R, L) are such formed that a parabola providing the second focus of said elliptic reflecting surfaces 6 (R, L) as a focus appears on the cross section to the vertical direction, for example, and diffuse after converging once in the horizontal direction to radiate luminous flux which will become a parallel light beam in the vertical direction by the ellipsoid given on said cross section of the horizontal direction in conjunction therewith. And then, the major axis of said ellipse is directed toward the front of the vehicle in this third embodiment Moreover, said lower right reflecting surface 7R and lower left reflecting surface 7L are provided corresponding to the position of the lower half portion omitted since only the upper half portion of the main reflecting surface 3 is used, whereby an optical interference with said main reflecting surface 3 is designed to not cause as described above. Moreover, according to the invention, the shield plate 4, the shade 5, said right elliptic reflecting surface 6R and the lower reflecting surfaces 7 (R, L) are integrally molded by resin members, for example, and are formed integrally with the main reflecting surface 3 by the installation section 8 as shown in FIG. 1.

At this point, discussing the optical path from the elliptic reflecting surfaces 6 (R, L) to lower reflecting surfaces 7 (RR, LL) in detail, the shield plate 4 exists therebetween, so the optical path is shielded. Accordingly, the opening 4*a* is provided in order to secure the optical path for the light, which reflects on the elliptic reflecting surfaces 6 (R, L) to reach lower reflecting surfaces 7 (RR, LL).

Moreover, since said opening 4*a* is provided, a direct light from the arc 2*a* also leaks from this opening 4*a*, it would be caused the possibility that function as the shield plate 4 is detracted. Accordingly, the secondary focus f2 should be in the vicinity of said shield plate 4 when setting the shape of the elliptic reflecting surfaces 6 (R, L).

Or, assuming that said shield plate 4 exists in the vicinity of the secondary focus f2 when setting the shape of the shield plate 4, the secondary focus f2 is positioned at the position on which reflected light from the elliptic reflecting surfaces 6 (R, L) converges, whereby a bore of the opening 4*a* can be made small and influence of leakage light can be minimized. Further speaking, leakage light can be minimized more and more when the bore of the opening 4*a* is formed small, as well as providing at the position which becomes a shadow of the stripe described in the prior examples.

According to the constitution described above, the headlamp 1 captures the light which is radiated toward the front upper from the arc 2*a* which is shielded by the shade or the like and, heretofore, could not be used by said elliptic reflecting surfaces 6 (R, L) and to project it toward the irradiating direction by the lower reflecting surfaces 7 (R, L), whereby the capture factor of luminous flux is improved and the headlamp 1 increased in intensity in light can be realized.

Figure 14:
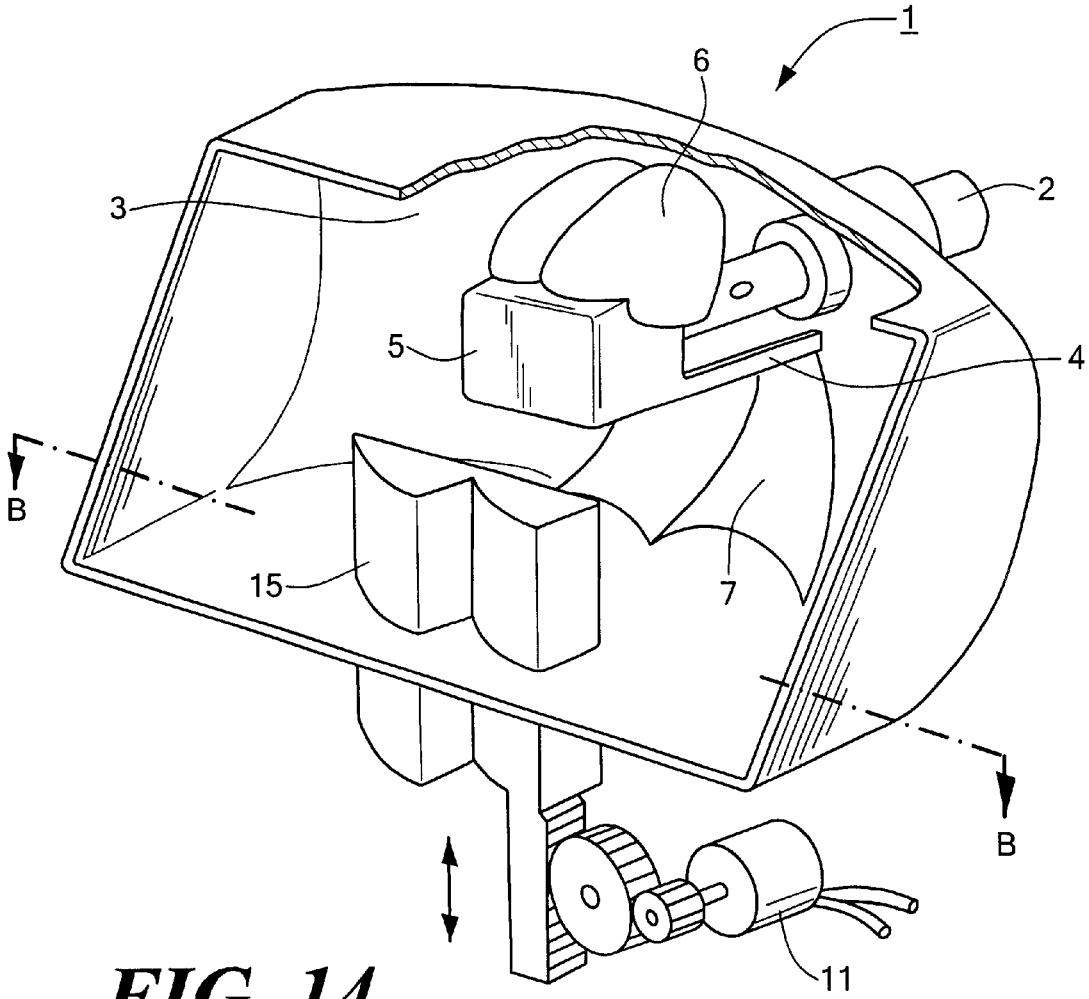
FIG. 14 is a perspective view showing a sixth embodiment of a headlamp according to the invention.
Figure 15:
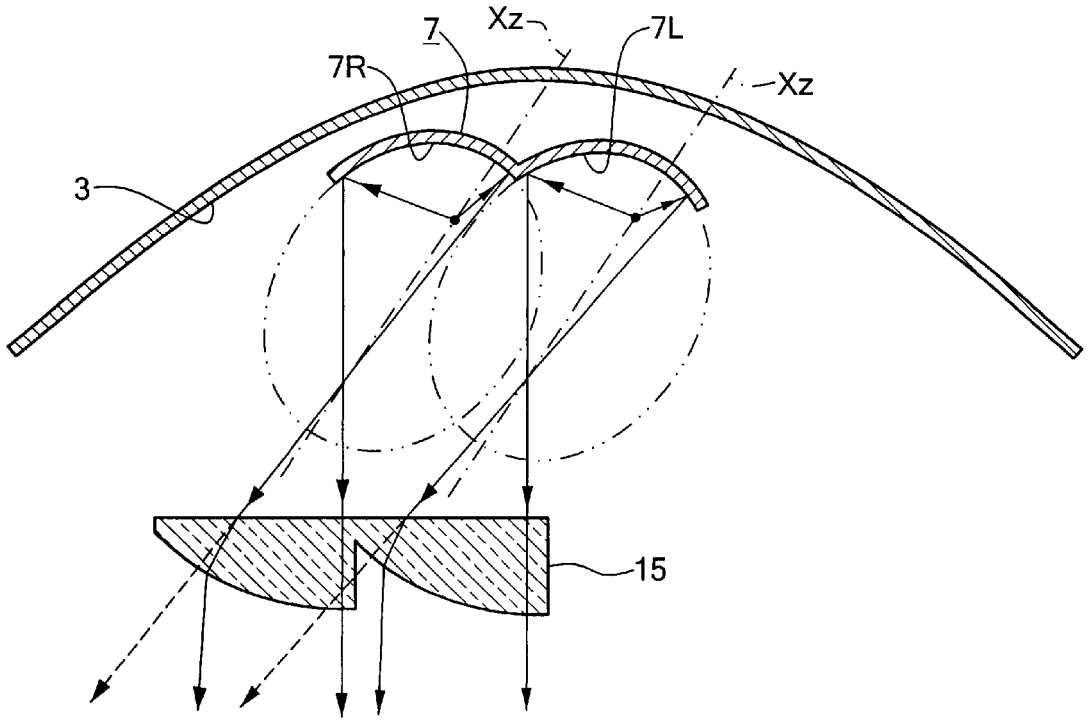
FIG. 15 is a sectional view along line B—B in FIG. 14.
Figure 16:
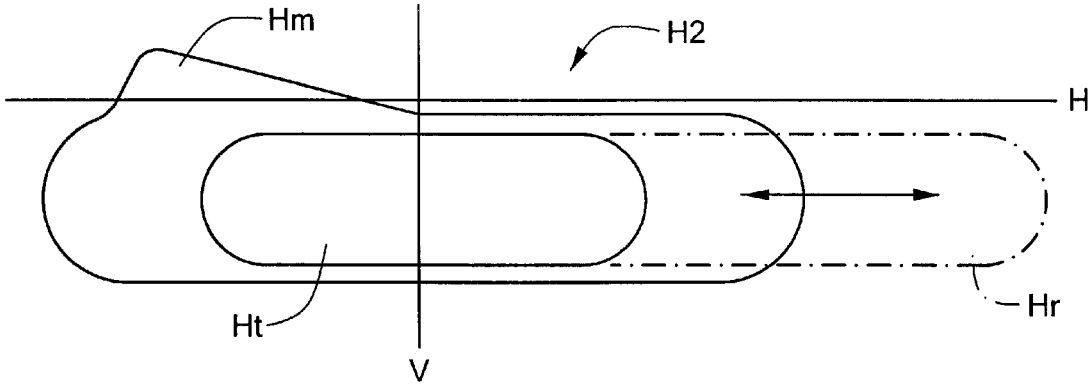
FIG. 16 is an illustration showing a condition of a light distribution obtained by the sixth embodiment.

FIGS. 14 to 16 show sixth embodiment of the headlamp 1 according to this invention. In this fourth embodiment, the major the axes Xz of said lower reflecting surfaces 7 (R, L) are inclined toward the right side for the headlamp 1 to be inserted on the right side of the vehicle, and the major axes Xz thereof are inclined toward the left side (in the condition as illustrated) for the headlamp 1 to be inserted on the left side of the vehicle (not shown).

Moreover, a refracting means 15 which is formed into a shape as obtained by cutting out only a half of one hand from a center axis of a cylindrical plano-convex lens and to combine them and has a refracting action to one direction and a converging action is provided on the front of said lower reflecting surfaces 7 (R, L), for example, and this refracting means 15 is designed to enter into or exit from the optical path of the lower reflecting surfaces 7 (R, L) freely by a motor 16 or the like, for example.

At this point of time, since the major axis Xz of said refracting means 15 is inclined when the light reflected by said lower reflecting surfaces 7 (R, L) transmits the refracting means 15, said refracting means 15 is set such that the lower reflecting surfaces 7 (R, L) of the headlamp 1 installed on the right side of the vehicle, for example, refract the light traveling toward the left which is produced toward the front direction of the vehicle, as well as converge an angle at which the light reflected by said lower reflecting surfaces 7 (R, L) is diffused by the ellipsoid set in the horizontal cross section to a smaller diffusion angle.

In addition, said refracting means 15 is designed to hold the condition of being inserted in luminous flux from the lower reflecting surfaces 7 (R, L) when the steering is not operated, only the refracting means 15 of the headlamp 1 of the right side is designed to exit from in luminous flux from the lower reflecting surfaces 7 (R, L) when the steering is not operated to turn to the right, and only the refracting means 15 of the headlamp 1 of the left side is designed to exit from in luminous flux from the lower reflecting surfaces 7 (R, L) when the steering is not operated to turn to the left.

FIG. 16 shows a light distribution characteristic H2 of a sixth embodiment constituted as described. First, said refracting means 15 is inserted into luminous flux from the lower reflecting surfaces 7 (R, L) in the headlamp 1 installed on the right side of the vehicle and in the headlamp 1 installed on the left side of the vehicle, in the condition that the vehicle drives straight ahead, that is, the steering is not operated to turn to the right. Therefore, the light from the lower reflecting surfaces 7 (R, L) is projected as a light distribution Ht with the narrow diffusion angle in the front direction of the vehicle and to be added to the light distribution for the low beam Hm from the main reflecting surface 3 and to irradiate the road surface of the front direction brightly.

Figure 17:
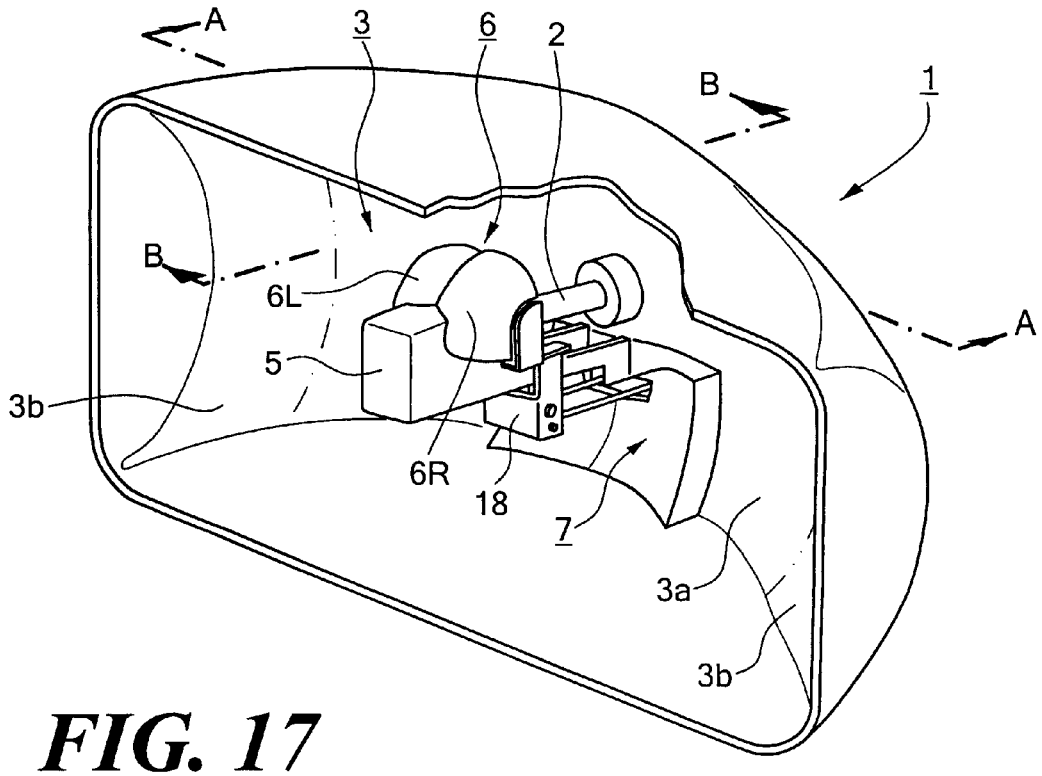
FIG. 17 is a perspective view showing a seventh embodiment of a headlamp according to the invention.
Figure 18:
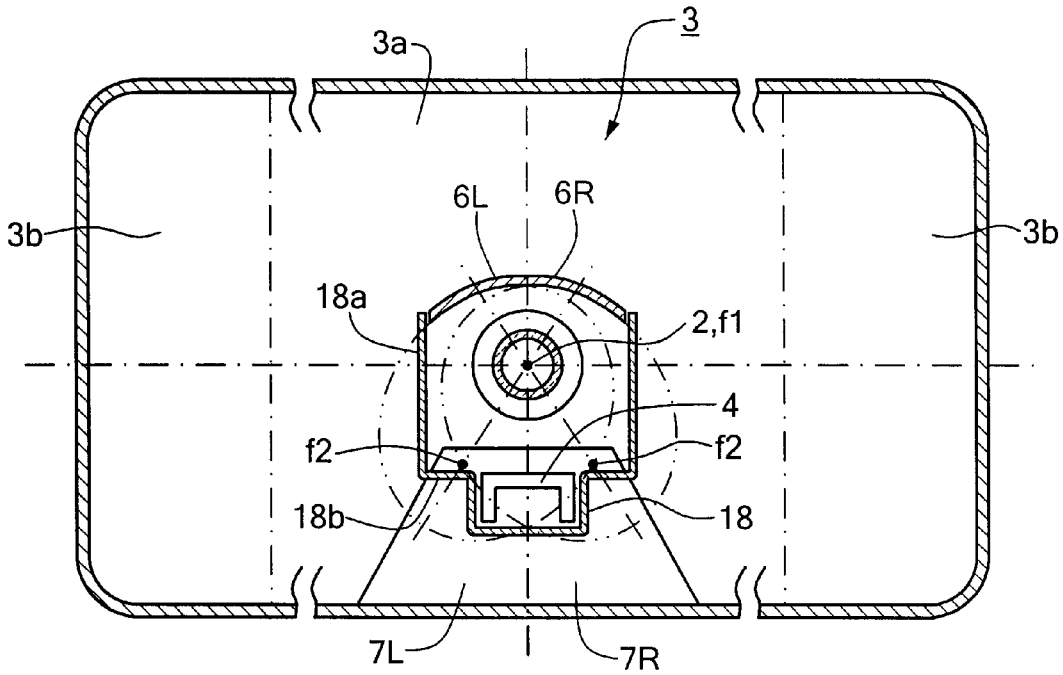
FIG. 18 is a sectional view along line A—A in FIG. 17.
Figure 19:
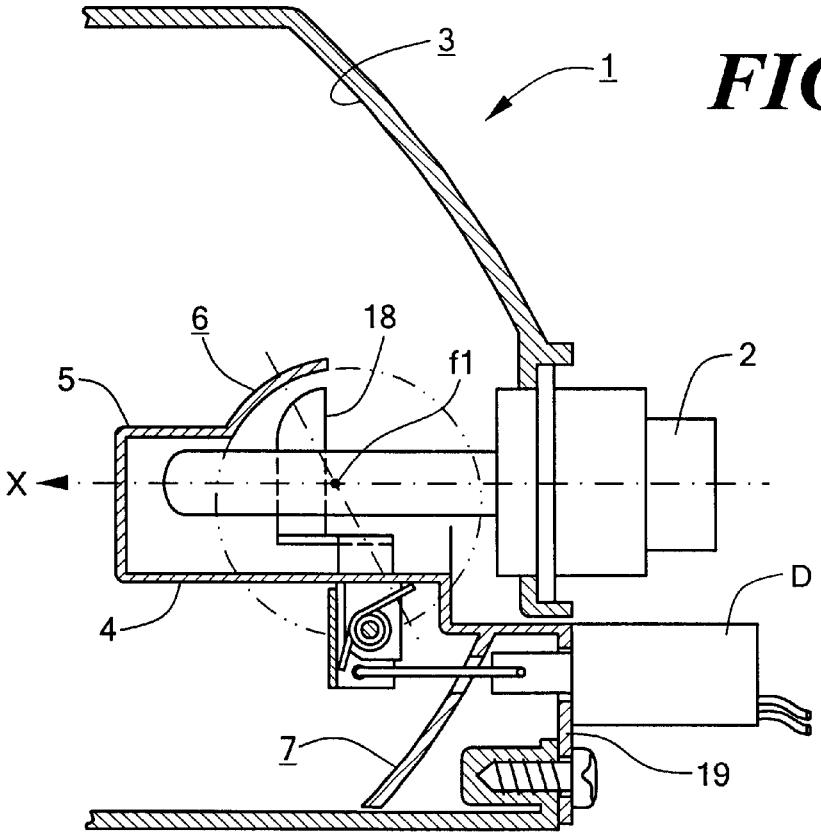
FIG. 19 is a sectional view along line B—B in FIG. 17.

At this point, only the refracting means 15 of the headlamp 1 of the right side exits from in luminous flux from the lower reflecting surfaces 7 (RR, LL) and is directed to the right direction and to produce the widely-diffusing light distribution Hr and to irradiate the right direction of the front of the vehicle widely when the steering is not operated to turn to the right, for example, whereby the light distribution adaptable to turning to the right can be obtained in conjunction with the light distribution Hm from the main reflecting surface 3. In the same manner, the light distribution adaptable to turning to the left can be obtained by the light distribution from the headlamp 1 of the left side, when the steering is operated to turn to the left. Next, the invention will be described in detail based on embodiments shown in drawings. Referring to FIG. 17 to FIG. 18, a reference numeral 1 shows the headlamp of a seventh according to the invention. This headlamp 1 is provided with a light source 2, a reflector 3, a shield plate 4 and a shade 5 as is described above in the same manner.

At this point, according to the invention, a pair of elliptic reflecting surfaces 6 (R, L) formed integrally with said shade 5 is provided in bilateral symmetry with respect to an optical axis X, which each of said elliptic reflecting surfaces 6 takes the light source 2 as a primary focus f1. And then, the position at which this elliptic reflecting surface 6 is provided is the front and upper of said light source 2, and it is a range which cannot reach said reflector 3, that is, the portion which heretofore, have been shielded by the shade.

Moreover, it may be formed integrally on said shade 5 a stay 19 for coupling to the reflector 3 the constitution obtained by integrally forming the shield plate 4 shielding the colored light which is radiated downwardly from the light source 2 and these elliptic reflecting surfaces 6, the parabolic reflecting surfaces 7 (R, L), the shield plate 4 and the movable shield plate 18 or the like, as well as the elliptic reflecting surfaces 6 (R, L) described above and the parabolic reflecting surfaces 7 (R, L) which will be described below.

The secondary focus f2 of said respective elliptic reflecting surface 6 is provided on the side on which each is provided as is the substantially left side of the light source 2 in the case of the left elliptic reflecting surface 6L which said elliptic reflecting surface 6 is provided on the left side of the light source 2, or the substantially right side of the light source 2 in the case of the right elliptic reflecting surface 6R, and in addition, the parabolic reflecting surfaces 7 (R, L) with a horizontal-reflecting direction is provided on the lower of said reflector 3 by forming the paraboloid of revolution providing the secondary focus f2 of said respective elliptic reflecting surfaces 6 (R, L) as a focus.

Moreover, although it is the same in the point that a main reflecting surface 3*a* for forming the light distribution for the low beam on said reflector 3 and an auxiliary reflecting surface 3*b* for forming the light distribution for the upper beam are provided also in the headlamp 1, the auxiliary reflecting surfaces 3*b* are provided only on the sides of the left and right of the main reflecting surface 3*a* as also shown in FIG. 18, differing from the prior art, according to the invention.

Figure 21:
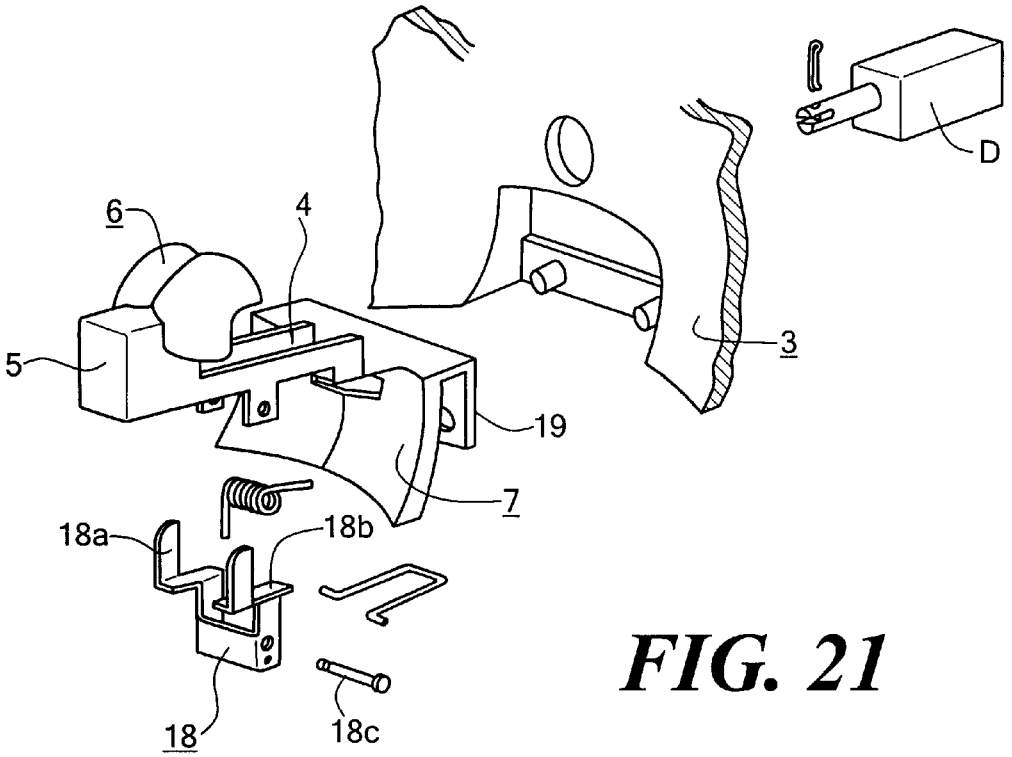
FIG. 21 is a perspective view showing component parts of the seventh embodiment of the headlamp according to the invention, the component parts being shown in the decomposed condition.
Figure 24:
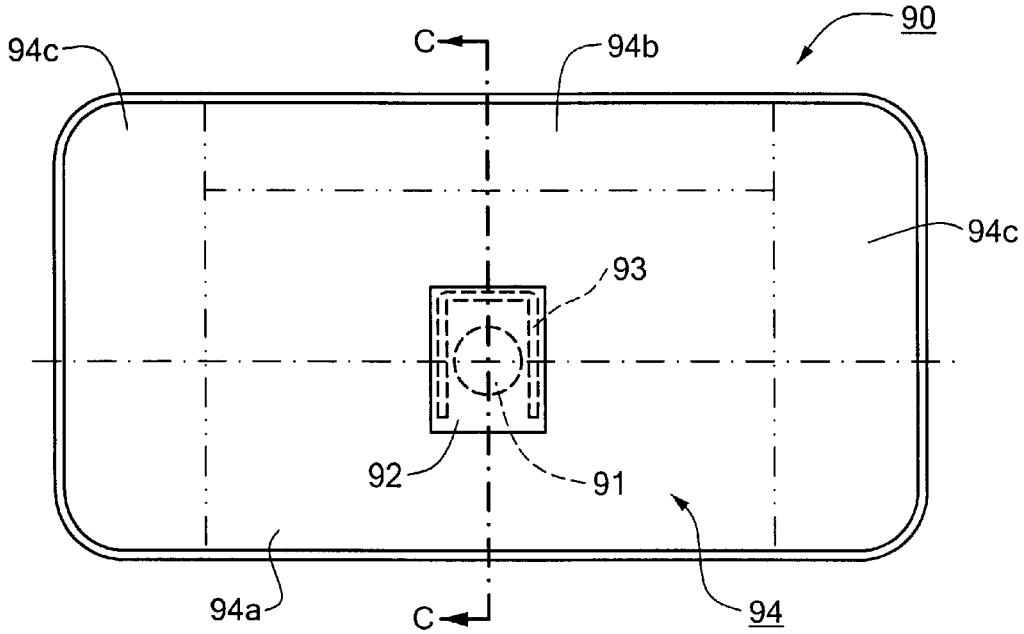
FIG. 24 PRIOR ART
FIG. 24 is a front elevation showing the prior example.
Figure 22:
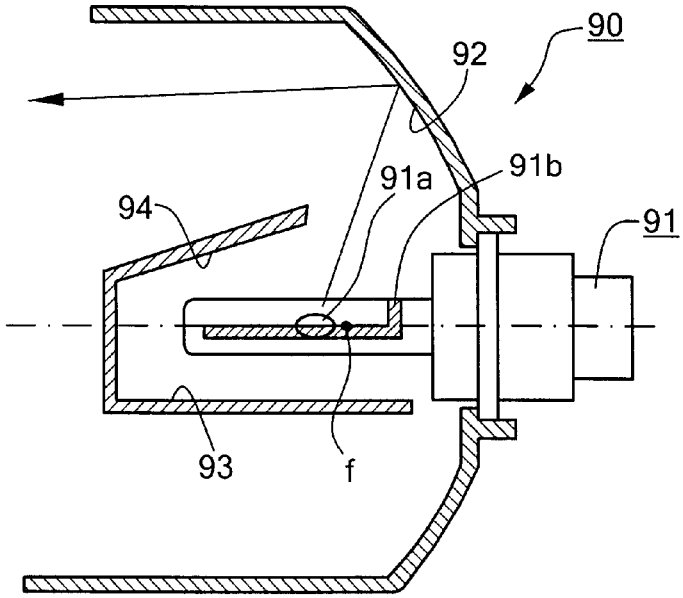
FIG. 22 PRIOR ART
FIG. 22 is a sectional view showing a prior example.
Figure 23:
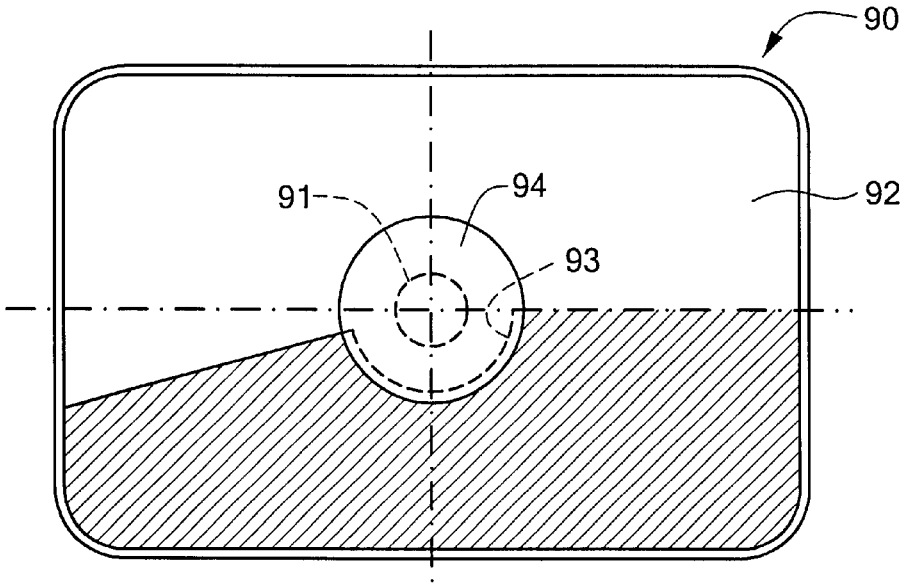
FIG. 23 PRIOR ART
FIG. 23 is an illustration showing a reaching condition of light from a light source to a reflecting surface in the same prior example.

In addition, although the movable shield plate 18 which is moved between two predetermined positions by a driving device D such as a solenoid is provided also in the headlamp 1 according to the invention, this movable shield plate 18 is constituted by a side shielding section 18*a* shielding for the light from the light source 2 reaching the auxiliary reflecting surfaces 3*b* provided on the sides of the left and right of the main reflecting surface 3*a* when being not moved by the driving device D and a lower shielding section 18*b*_ shielding the optical path_that the light from the light source 2 reflects at said elliptic reflecting surface 6 and to direct to the parabolic reflecting surface 7, and is installed on the shade 5 by the shaft 18*c* so as to turn freely as also shown in FIG. 21, for example.

Figure 20:
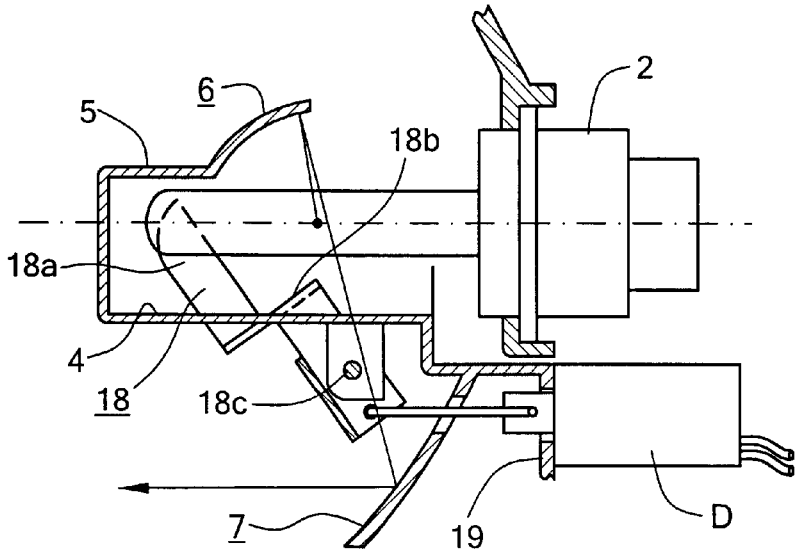
FIG. 20 is an illustration showing an operating condition of a movable shield plate.
Figure 25:
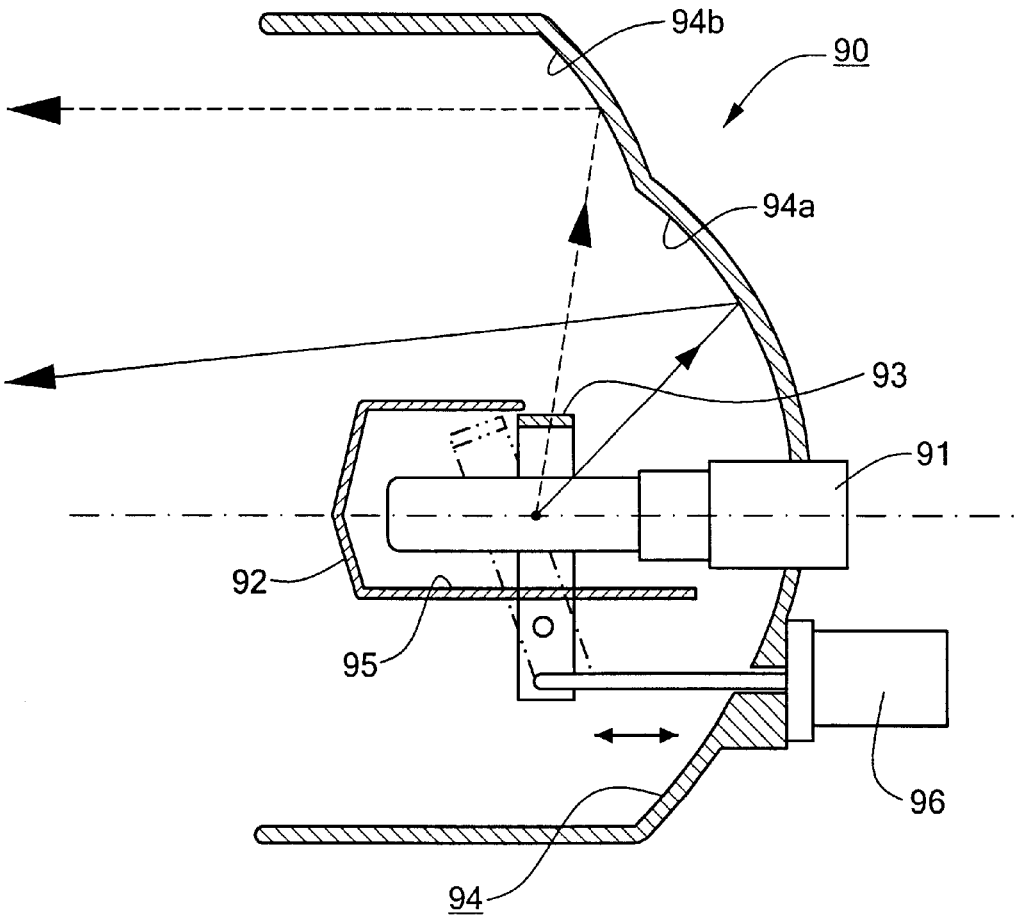
FIG. 25 PRIOR ART
FIG. 25 is a sectional view along line C—C in FIG. 24.

And then, it exits from the optical path from the light source 2 to the auxiliary reflecting surface 3*b* and the optical path from the elliptic reflecting surface 6 to the parabolic reflecting surface 7 as shown in FIG. 20 when being moved by the driving device D, and the light is incident on these auxiliary reflecting surface 3*b* and the parabolic reflecting surface 7. Accordingly, the light irradiated to the front as the headlamp 1 can realize the light distribution for the upper beam by adding the light from the auxiliary reflecting surface 3*b* each being irradiated to the front direction and the light from the parabolic reflecting surface 7 to the light distribution for the low beam from the main reflecting surface 3*a* of the main reflecting surface 3 (refer also to FIG. 25).

Figure 26:
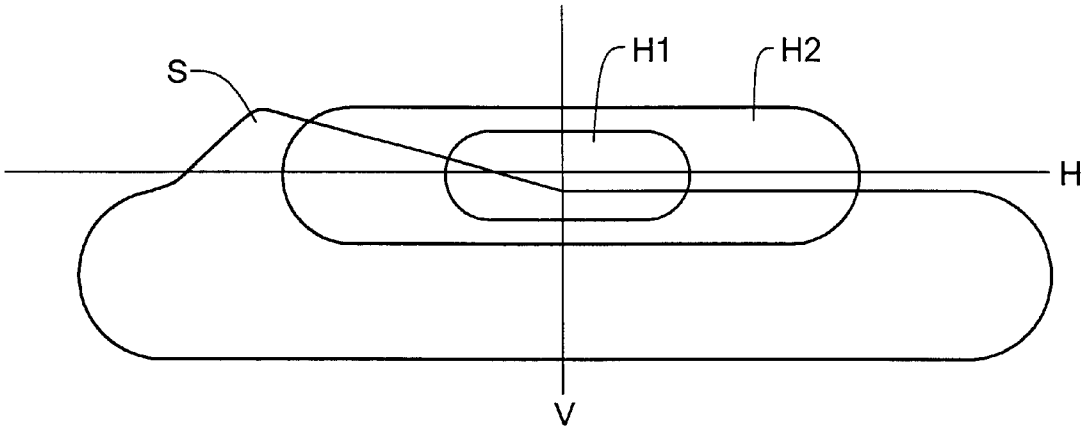
FIG. 26 PRIOR ART
FIG. 26 is an illustration showing a method for switching the light distribution of a variable light-distribution headlamp of this type.

Moreover, the light distribution (corresponds to the light distribution H2 in FIG. 26) for irradiating the left and right direction of the vehicle widely is formed by the auxiliary reflecting surfaces 3*a* provided on the side of the left and right of the main reflecting surface 3*a* and the light distribution (corresponds to the light distribution H1 in FIG. 26) for irradiating the front direction of the vehicle as a spot by the portion obtained by combining the elliptic reflecting surfaces 6 with the parabolic reflecting surface 7, also in the invention.

Subsequently, actions and effects of the headlamp 1 according to the invention constituted as described above will be described below.

104) First, the portion provided on the main reflecting surface 3*a* of the inside of the auxiliary reflecting surface 3*b* becomes unnecessary according to the invention, whereby an area of the main reflecting surface 3*a* is increased, so that the light distribution for the low beam used at all time becomes bright.

At this point, it appears that the area of the main reflecting surface 3*a* is made narrow since the auxiliary reflecting surfaces 3*b* is provided on the sides of the left and right of the main reflecting surface 3*a* still more, however, since there is a dimensional margin in the left and right direction of the vehicle body in many cases and it is possible to extend, the auxiliary reflecting surface 3*b* can be formed, extending the dimension, whereby light can not be lost in amount of light substantially.

Moreover, the elliptic reflecting surfaces 6 is designed to provide on the front and upper of said light source 2 and further to reflect the reflected light from this elliptic reflecting surface 6 to the front direction by the parabolic reflecting surface 7, thereby the auxiliary reflecting part provided on the upper of the main reflecting surface 3*a* in the prior examples to be replaced therewith, whereby the capture factor of luminous flux to the light source 2 can be improved as the entire headlamp 1 since said elliptic reflecting surface 6 recovers the light of the area which is shielded by the shade because of the portion by which the glare light is caused and heretofore can not be used and to convert into the irradiating light as described above.

The light distribution for the low beam used at all time is not only made bright, but also the light distribution for the upper beam which are used when driving at high speed on the expressway and the suburbs or the like, for example, is made bright by this constitution, that is, a more bright headlamp 1 can be realized even using the light source 2 with the same intensity of light.

Moreover, since said movable shield plate 18 is constituted in the substantially same manner as the prior examples, including the driving device D, moreover, said elliptic reflecting surface 6 and parabolic reflecting surface 7 also are the shapes which can be formed with the shade 5 integrally, the cost of parts or the number of manpower is not increased as compared to the prior examples, whereby the actions and effects described above can be realized without increase in products cost.

As described above, according to the invention, a headlamp can be realized which is constituted by providing on a substantial upper half portion a main reflecting surface formed into a parabolic surface providing a light-emitting source of a bulb as a substantial focus, wherein a right elliptic reflecting surface and a left elliptic reflecting surface providing the vicinity of a light-emitting source of a bulb as a primary focus respectively are provided on a position toward the front upper of the bulb in the form of being connected substantially along a center line of this headlamp, a second focus of said right elliptic reflecting surface being provided on the appropriate right side of said bulb, a second focus of said left elliptic reflecting surface being provided on the appropriate left side of said bulb, a right parabolic reflecting surface providing the second focus of said right elliptic reflecting surface as a focus is provided on a position toward the lower and right of said main reflecting surface, and a left parabolic reflecting surface providing the second focus of said left elliptic reflecting surface as a focus is provided on a position toward the lower and left of said main reflecting surface, whereby the light except for the light traveling in an upward direction from the bulb 2 and toward the main reflecting surface can be recovered and to convert into the light which can be used as the irradiating light, and a problem can be solved that the utilization factor of luminous flux with respect to the light source 91 is low, which has been occurred in the headlamp of this type, and the extremely excellent effects can be performed for improvement in a performance of the headlamp.

Moreover, the headlamp can be realized that optical paths of the reflected light from said right parabolic reflecting surface and left parabolic reflecting surface are designed to be substantially parallel each other, or to intersect each other at front of the headlamp, as well as at least a part of the optical paths from said two parabolic reflecting surfaces is provided with a light-distribution varying means constituted by reflecting means or refracting means, whereby, first, said elliptic reflecting surfaces 6 recovers the light which is shielded by the shade or the like because of the cause by which the glare light is caused, and which heretofore can not be used, said light being radiated in an upward direction from the bulb and toward the front, and the light is converted into an usable light as the irradiating light by the parabolic reflecting surface, whereby the extremely excellent effects can be performed for improvement in performance of the headlamp of this type.

In addition, the headlamp can be realized which is constituted by providing on a substantial upper half portion a main reflecting surface formed into a parabolic surface providing a light-emitting source of a bulb as a substantial focus, wherein a right elliptic reflecting surface and a left elliptic reflecting surface providing the vicinity of a light-emitting source of a bulb as a primary focus respectively and each is formed into at least one piece are provided on a position toward the front upper of the bulb in the form of being connected substantially along a center line of this headlamp, a second focus of said right elliptic reflecting surface being provided on the appropriate right side of said bulb, a second focus of said left elliptic reflecting surface being provided on the appropriate left side of said bulb, at least a reflecting surface of a lower right portion which an ellipsoid providing the second focus of said right elliptic reflecting surface as a primary focus appears on a horizontal section on a position toward the lower and left of said main reflecting surface, and at least a reflecting surface of a lower left portion which the ellipsoid providing the second focus of said left elliptic reflecting surface as the primary focus appears on the horizontal section on the position toward the lower and right of said main reflecting surface, whereby the light which heretofore can not be used, said light being radiated in an upward direction from the bulb and toward the front, also is converted into an usable light as the irradiating light by the elliptic reflecting surfaces and the lower reflecting surface, and the headlamp can be realized more brightly if being the headlamp with the same projecting area or it can be more miniaturized if being the same intensity of light, and the extremely excellent effects can be performed for improvement in performance.

Moreover, since said parabolic reflecting surface is provided on the position at which the optical interference with said main reflecting surface 3 is occurred, the mirror and lens or the like for converting the light distribution characteristic can be installed in the optical paths from this parabolic reflecting surface freely, whereby a plurality of applications such as a cornering lamp, the light distribution for the low beam corresponding to a driving speed, or switching between the light distribution for the low beam and the light distribution for the upper beam, for example, has been made possible, and the extremely excellent effects also can be performed for improvement in performance of the headlamp of this type. Moreover, the headlamp can be realized that the major axis of the ellipsoid set on the lower right reflecting surface and the lower left reflecting surface are inclined toward the side direction of the vehicle body on which this headlamp is mounted or the traffic zone specified by traffic regulations in the country in which this vehicle body is used, and at least refracting means for changing the traveling direction of light within the horizontal plane which enters into or exits from the optical path of the lower right reflecting surface and the lower left reflecting surface freely is provided, whereby the extremely excellent effects also can be performed for improvement in performance of the headlamp of this type, including the action of the so called cornering lamp.

Moreover, the headlamp can be realized which is constituted by providing on a substantial upper half portion a main reflecting surface formed into a parabolic surface providing a light-emitting source of a bulb as a substantial focus, wherein a right elliptic reflecting surface and a left elliptic reflecting surface providing the vicinity of a light-emitting source of a bulb as a primary focus respectively are provided on a position toward the front upper of the bulb in the form of being connected substantially along a center line of this headlamp, a second focus of said right elliptic reflecting surface being provided on the appropriate right side of said bulb, a second focus of said left elliptic reflecting surface being provided on the appropriate left side of said bulb, a right parabolic reflecting surface providing the second focus of said right elliptic reflecting surface as a focus is provided on a position toward the lower and right of said main reflecting surface, and a left parabolic reflecting surface providing the second focus of said left elliptic reflecting surface as a focus is provided on a position toward the lower and left of said main reflecting surface, whereby, the light which heretofore has been used, said light being radiated in an upward direction from the bulb and toward the front, is designed to be captured by the elliptic reflecting surfaces and to be projected in the horizontal direction by the parabolic reflecting surface and to form the light distribution for the upper beam, and, first, the auxiliary reflecting part provided on the up-and-down direction of the main reflecting portion of which dimension is hard to elongate as the headlamp is replaced with said elliptic reflecting surfaces and parabolic reflecting surface, whereby it is prevented that the light distribution for the low beam used at all time becomes poor in intensity, and the extremely excellent effects also can be performed for improvement in performance such as improvement in visibility of the headlamp of this type.

What is claimed is:

1. A headlamp constituted by providing on a substantial upper half portion a main reflecting surface formed into a parabolic surface providing a light-emitting source of a bulb as a substantial focus;

wherein a right elliptic reflecting surface and a left elliptic reflecting surface providing in the vicinity of a light-emitting source of said bulb a first focus respectively are provided on the front upper portion of the bulb selectively being connected substantially along a center line of said headlamp, a second focus of said right elliptic reflecting surface being provided on the appropriate right side of said bulb, a second focus of said left elliptic reflecting surface being provided on the appropriate left side of said bulb, a right parabolic reflecting surface providing the second focus of said right elliptic reflecting surface as a focus is provided on the lower right portion of said main reflecting surface, and a left parabolic reflecting surface providing the second focus of said left elliptic reflecting surface as a focus is provided on the lower left portion of said main reflecting surface;

wherein optical paths of the reflected light from said right parabolic reflecting surface and left parabolic reflecting surface are designed to be substantially parallel each other, or to intersect each other at front of the headlamp, as well as at least a part of the optical paths from said two parabolic reflecting surfaces is provided with a light-distribution varying means constituted by reflecting means or refracting means; and wherein said light-distribution varying means is reflecting means, and is a rotary mirror of which a rotary shaft is set to a vertical direction and both the front surface and rear surface are provided as reflecting surfaces, said mirror being provided in the optical path from said two parabolic reflecting surfaces.

2. The headlamp according to claim 1, wherein said light-distribution varying means comprises changing means for changing the optical paths from said two parabolic reflecting surfaces to an upward direction or the downward direction.

3. The headlamp according to claim 1, wherein said light-distribution varying means comprises changing means for changing the optical paths from said two parabolic reflecting surfaces to an upward direction or the downward direction.

4. A headlamp constituted by providing on a substantial upper half portion a main reflecting surface formed into a parabolic surface providing a light-emitting source of a bulb as a substantial focus;

wherein a right elliptic reflecting surface and a left elliptic reflecting surface providing in the vicinity of a light-emitting source of said bulb a first focus respectively are provided on the front upper portion of the bulb selectively being connected substantially along a center line of said headlamp, a second focus of said right elliptic reflecting surface being provided on the appropriate right side of said bulb, a second focus of said left elliptic reflecting surface being provided on the appropriate left side of said bulb, a right parabolic reflecting surface providing the second focus of said right elliptic reflecting surface as a focus is provided on the lower right portion of said main reflecting surface, and a left parabolic reflecting surface providing the second focus of said left elliptic reflecting surface as a focus is provided on the lower left portion of said main reflecting surface;

wherein optical paths of the reflected light from said right parabolic reflecting surface and left parabolic reflecting surface are designed to be substantially parallel each other, or to intersect each other at front of the headlamp, as well as at least a part of the optical paths from said two parabolic reflecting surfaces is provided with a light-distribution varying means constituted by reflecting means or refracting means; and wherein said light-distribution varying means is reflecting means, and is a movable mirror which is formed into a wedge shape of which a tip is set to a light source side, said mirror being provided so as to enter in or exit from the optical path from said two parabolic reflecting surfaces freely.

5. The headlamp according to claim 4, wherein said movable mirror has a plurality of vertexes changing in stages or gradually.

6. The headlamp according to claim 4, wherein said light-distribution varying means comprises changing means for changing the optical paths from said two parabolic reflecting surfaces to an upward direction or the downward direction.

7. The headlamp according to claim 5, wherein said light-distribution varying means comprises changing means for changing the optical paths from said two parabolic reflecting surfaces to an upward direction or the downward direction.

8. A headlamp constituted by providing on a substantial upper half portion a main reflecting surface formed into a parabolic surface providing a light-emitting source of a bulb as a substantial focus;

wherein a right elliptic reflecting surface and a left elliptic reflecting surface providing in the vicinity of a light-emitting source of said bulb a first focus respectively are provided on the front upper portion of the bulb selectively being connected substantially along a center line of said headlamp, a second focus of said right elliptic reflecting surface being provided on the appropriate right side of said bulb, a second focus of said left elliptic reflecting surface being provided on the appropriate left side of said bulb, a right parabolic reflecting surface providing the second focus of said right elliptic reflecting surface as a focus is provided on the lower right portion of said main reflecting surface, and a left parabolic reflecting surface providing the second focus of said left elliptic reflecting surface as a focus is provided on the lower left portion of said main reflecting surface;

wherein optical paths of the reflected light from said right parabolic reflecting surface and left parabolic reflecting surface are designed to be substantially parallel each other, or to intersect each other at front of the headlamp, as well as at least a part of the optical paths from said two parabolic reflecting surfaces is provided with a light-distribution varying means constituted by reflecting means or refracting means; and wherein said light-distribution varying means is reflecting (refracting) means, and is a movable lens formed into substantially cylindrical-shaped lens, said lens being provided so as to enter in or exit from the optical path from said two parabolic reflecting surfaces freely.

9. The headlamp according to claim 8, wherein said movable lens has a plurality of curvatures changing in stages or gradually.

10. The headlamp according to claim 8, wherein said light-distribution varying means comprises changing means for changing the optical paths from said two parabolic reflecting surfaces to an upward direction or the downward direction.

11. The headlamp according to claim 9, wherein said light-distribution varying means comprises changing means for changing the optical paths from said two parabolic reflecting surfaces to an upward direction or the downward direction.

12. A headlamp constituted by providing on a substantial upper half portion with a main reflecting surface formed into a parabolic surface providing a light-emitting source of a bulb as a substantial focus, wherein a right elliptic reflecting surface and a left elliptic reflecting surface providing in the vicinity of a light-emitting source of a bulb with a first focus respectively and formed into at least one piece are provided on a front upper position of the bulb as a form (of being) connected substantially along a center line of said headlamp, a second focus of said right elliptic reflecting surface being provided on the appropriate right side of said bulb, a second focus of said left elliptic reflecting surface being provided on the appropriate left side of said bulb, at least a reflecting surface of a lower right portion being provided in which an ellipsoid having the second focus of said right elliptic reflecting surface as a first focus appears on a horizontal section on a lower left position of said main reflecting surface, and at least a reflecting surface of a lower left portion in which the ellipsoid providing the second focus of said left elliptic reflecting surface as the first focus appears on the horizontal section on the lower right position of said main reflecting surface is provided;

wherein major axes of the ellipsoid set on said lower right reflecting surface and lower left reflecting surface are inclined toward the side direction of a vehicle body on which said headlamp is mounted or a traffic zone specified by traffic regulations in the country in which said vehicle body is used; and wherein at least refracting means for changing a traveling direction of light within a horizontal plane is provided, said refracting means being provided so as to enter in or exit from the optical paths of said lower right reflecting surface and lower left reflecting surface freely.

* * * * *